US007637575B2

(12) United States Patent
Amari et al.

(10) Patent No.: US 7,637,575 B2
(45) Date of Patent: Dec. 29, 2009

(54) OPEN SHOWCASE

(75) Inventors: Youichi Amari, Ota (JP); Shouichi Kanai, Gunma-ken (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 304 days.

(21) Appl. No.: 11/709,138

(22) Filed: Feb. 22, 2007

(65) Prior Publication Data

US 2007/0194671 A1 Aug. 23, 2007

(30) Foreign Application Priority Data

Feb. 22, 2006 (JP) ..... 2006-045553

(51) Int. Cl.
*A47F 3/04* (2006.01)

(52) U.S. Cl. ..... 312/116

(58) Field of Classification Search ..... 312/116, 312/236, 406.2; 62/246, 249, 251, 256
See application file for complete search history.

(56) References Cited

U.S. PATENT DOCUMENTS 3,230,732 A * 1/1966 Rutishauser et al. ..... 62/255
5,626,028 A * 5/1997 Graat et al. ..... 312/116
7,014,280 B2 * 3/2006 Borgen et al. ..... 312/116
7,181,924 B2 * 2/2007 Duffy et al. ..... 312/116

FOREIGN PATENT DOCUMENTS

| | | |
|---|---|---|
| JP | 04 015475 | 1/1992 |
| JP | 08 121944 | 5/1996 |
| JP | 11023141 A * | 1/1999 |
| JP | 11-262432 | 9/1999 |
| JP | 2000 070082 | 3/2000 |

* cited by examiner

*Primary Examiner*—Hanh V Tran
(74) *Attorney, Agent, or Firm*—Kratz, Quintos & Hanson, LLP

(57) ABSTRACT

The object is to provide an open showcase which enables setting and removal of a front glass at the top of the front wall of the heat insulating wall and which, even if the front glass is not set, improves the aesthetic appearance of the front wall top of the heat insulating wall. The open showcase has a handrail at the top of the front wall of the heat insulating wall positioned at the bottom of the opening, wherein the handrail includes a handrail body mounted on the top of the front wall and having a recessed groove with an upper opening for insertion of a front glass therein, a front upper panel extending from the front edge of the opening of the recessed groove to the upper surface of the front top of the front wall, and a top cover inserted removably in the recessed groove to close the recessed groove and cover the top of the front upper panel.

4 Claims, 6 Drawing Sheets

OPEN SHOWCASE

TECHNICAL FIELD

The present invention relates to an open showcase comprising a handrail at the top of the front wall of the heat insulating wall positioned at the bottom of the opening.

BACKGROUND

Conventionally, some open showcases of this kind are designed to set a front glass upright at the top of the front wall of the heat insulating wall as described in Japanese Patent Laid-open Publication No. 11-262432, for example. This type of open showcase is provided with a step section at the back of the top surface of the front wall of the heat insulating wall so that the front glass can be set upright at the step section. A handrail is mounted on the top end on the front wall of the heat insulating wall located at the front of the front glass.

In this case, the rear end of the handrail top is bent along the front end of the step, and win the condition where the front glass is mounted, the back of the handrail inserted along the front end of the step is housed in the step section together with the front glass. In the condition where the front glass is not set upright, on the other hand, a fixed plate having a rectangular cover section at the top thereof is used for closing the step section without a front glass. Thus, the back of the handrail inserted along the front edge of the step section is housed in the step section together with the cover section.

In this case, in the condition where the front glass is not set upright, the top of the handrail is located higher than the cover section of the fixed plate and constitutes the topmost surface at the top end on the front wall of the heat insulating wall. Therefore, if the handrail is constituted by a steel plate material finished with painting, contact between the painted surface and goods causes several small flaws while the goods are placed in and removed from the showcase and the painting on the surface may peel off. When used for a long time, the top of the handrail has several fine splits resulting from small flaws. This is not preferable for use and from the aesthetic viewpoint.

Therefore, the present invention has been made to solve the conventional technical problems, and it is an object of the invention to provide an open showcase having a removable front glass at the top of the front wall of the heat insulating wall and an improved appearance of the top surface of the front wall of the heat insulating wall even in case a front glass is not set.

SUMMARY

An open showcase, according to a first aspect of the present invention, comprises a heat insulating wall with an opening and a handrail arranged at a top of a front wall of the heat insulating wall positioned at a bottom of the opening, wherein the handrail comprises a handrail body mounted on the top of the front wall and having a recessed groove with an upper opening for insertion of a front glass therein, a front upper panel extending from a front edge of the opening of the recessed groove to an upper part of a front surface of the front wall, and a top cover inserted removably in the recessed groove to close the recessed groove and to cover the top edge of the front upper panel.

According to a second aspect of the present invention, in the above-defined open showcase, an engagement section in which a protrusion of the top cover is engaged is formed inside of the recessed groove of the handrail body.

According to a third aspect of the present invention, in each of the above-defined open showcases, a card holder for removably holding a card is integrally formed with the top cover at the top thereof.

In the open showcase, according to the first aspect of the present invention, comprising a handrail at the top of the front wall of the heat insulating wall positioned at the bottom of the opening, since the arrangement is such that the handrail comprises a handrail body mounted on the top of the front wall and having the recessed groove with the upper opening for insertion of the front glass, a front upper panel extending from the front edge of the opening of the recessed groove to the upper part of the front surface of the front wall, and a top cover inserted removably in the recessed groove to close the recessed groove and cover the top edge of the front upper panel, it becomes possible to cover the recessed groove with the top cover even in the condition where the front glass is not mounted and the problem of dust deposition in the recessed groove can be solved.

In addition, because the top cover covers the top of the front upper panel extending to the upper part of the front surface of the front wall, it can be designed so that the top of the front upper panel is not touched while the goods are placed in and removed from the showcase. Therefore, even if the front upper panel is made of a steel plate finished with painting, flaws or peeling off of the paint can be avoided and the appearance can be improved.

In the above-defined open showcase according to the second aspect of the present invention, since the arrangement is such that the engagement section in which the protrusion of the top cover is engaged is formed in the recessed groove of the handrail body, the top cover can be stably engaged with the inside of the recessed groove of the handrail body and falling off of the top cover while the goods are placed in and removed from the showcase can be avoided.

In each of the above-defined open showcases according to the third aspect of the present invention, since the arrangement is such that the top cover for removably holding the card is formed integrally with the card holder at the top thereof, in the condition where recessed groove of the handrail body is covered with the top cover, price cards or other cards can be attached to the top cover. Thus, any information about the displayed goods can be arbitrarily attached while maintaining the unity of the showcase as a whole and the convenience is improved.

DETAILED DESCRIPTION OF THE EMBODIMENTS

Figure 1:
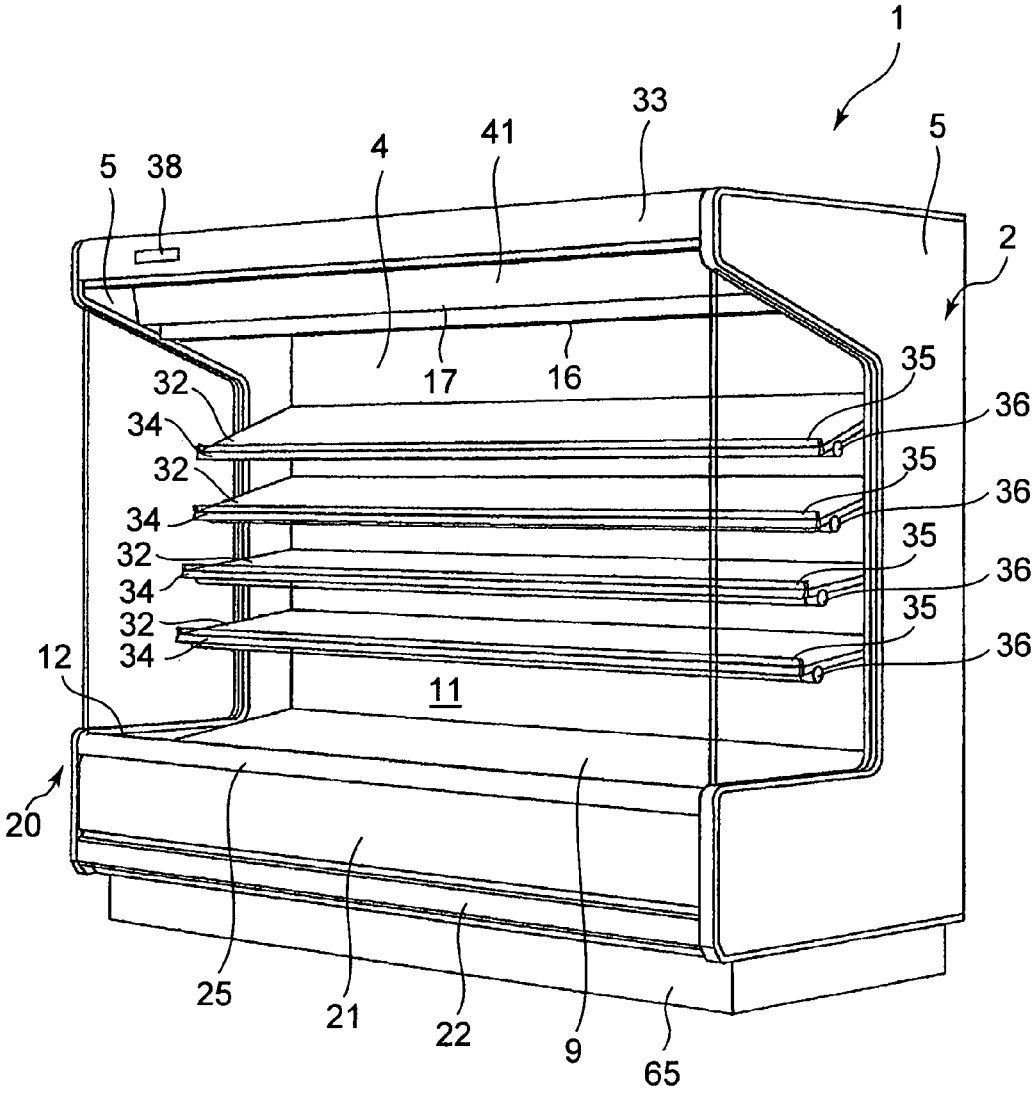
FIG. 1 is a perspective view of an open showcase according to the present invention.

Referring to the attached figures, an embodiment of the present invention is described below. An open showcase 1 is a vertical open showcase which can be used in such a manner that a plurality of showcases of this type are installed side by side in a store such as a supermarket or other shops, for example. It comprises a heat insulating wall 2 having a substantially falling U-shape in cross section with its front side open and heat insulating side plates 5, 5 mounted on the sides of the heat insulating wall 2 at the installation site. Note that the side plate 5 is mounted on the side of the heat insulating wall where any adjacent open showcase 1 does not exist and is not mounted on the side of the heat insulating wall 2 where an adjacent open showcase 1 exists. Details of the connection structure for the showcases 1 will be described later.

Inside of the heat insulating wall 2 of each open showcase 1, a partition plate 4 and another partition plate (not shown) are mounted at a certain distance therebetween, so that two-layered inner and outer ducts (not shown) are formed between the partition plate 4, another partition plate and the heat insulating wall 2.

At the front of the lower end of a back partition plate 10 constituting the inner partition plate, a bottom plate 9 is mounted with leaving a space for the duct between it and a bottom wall 2A of the heat insulating wall 2. The inside space defined by the partition plate 4 and the bottom plate 9 is called a display room 11.

Inside the display room 11, a pair of brackets 31 whose height and mounting angle can be changed are mounted on the pillars (not shown) at the back part of the display room 11, and shelf plates 32 constituting a shelf unit together with such brackets are installed to provide a plurality of stages. The shelf plate 32 has a price rail 34 made of hard synthetic resin at the front edge. The price rail 34 also serves as the decoration of the shelf plate 32. In addition, a predetermined space is kept between the front wall of the shelf plate 32 and the price rail 34, and a guard 35 to protect the goods on the shelf plate 32 from falling is mounted there. In addition, each shelf plate 32 is provided, at the front part of its bottom, with a lamp 36 to light the goods displayed on the lower shelf plate 32.

A front opening 12 of the heat insulating wall 2 has, at its top, an inner outlet 16 and an outer outlet 17, which are respectively provided with honeycomb materials 13 and 14. These inner outlet 16 and outer outlet 17 communicate with the inner layer duct and the outer duct described above respectively. In addition, at the bottom of the opening 12, an inner layer suction port 18 and an outer layer suction port 19 are provided.

At the rear section below the bottom plate 9, a plurality of air blowers (not shown) respectively corresponding to the above inner layer duct and the outer duct are installed on the bottom wall 2A of the heat insulating wall 2.

In the inner layer duct at the back of the back partition plate 10, cooling devices (not shown) of the cooling equipment are vertically installed. When the air blower corresponding to the inner layer duct is operated, the cool air obtained by heat exchange with the cooling device is raised in the inner layer duct and discharged from the inner outlet 16 toward the inner layer suction port 18. The cool air taken from the inner layer suction port 18 is accelerated by the above air blower again.

On the other hand, when the air blower corresponding to the outer duct is operated, the air in the outer duct is raised in the outer duct and discharged from the outer outlet 17 toward the outer layer suction port 19. The air taken from the outer layer suction port 19 is accelerated by the above air blower again. Thus, dual (front and back) air curtain is formed at the opening 12 and a part of the inner cool air curtain is circulated into the display room 11 so that the display room 11 is cooled down.

Figure 2:
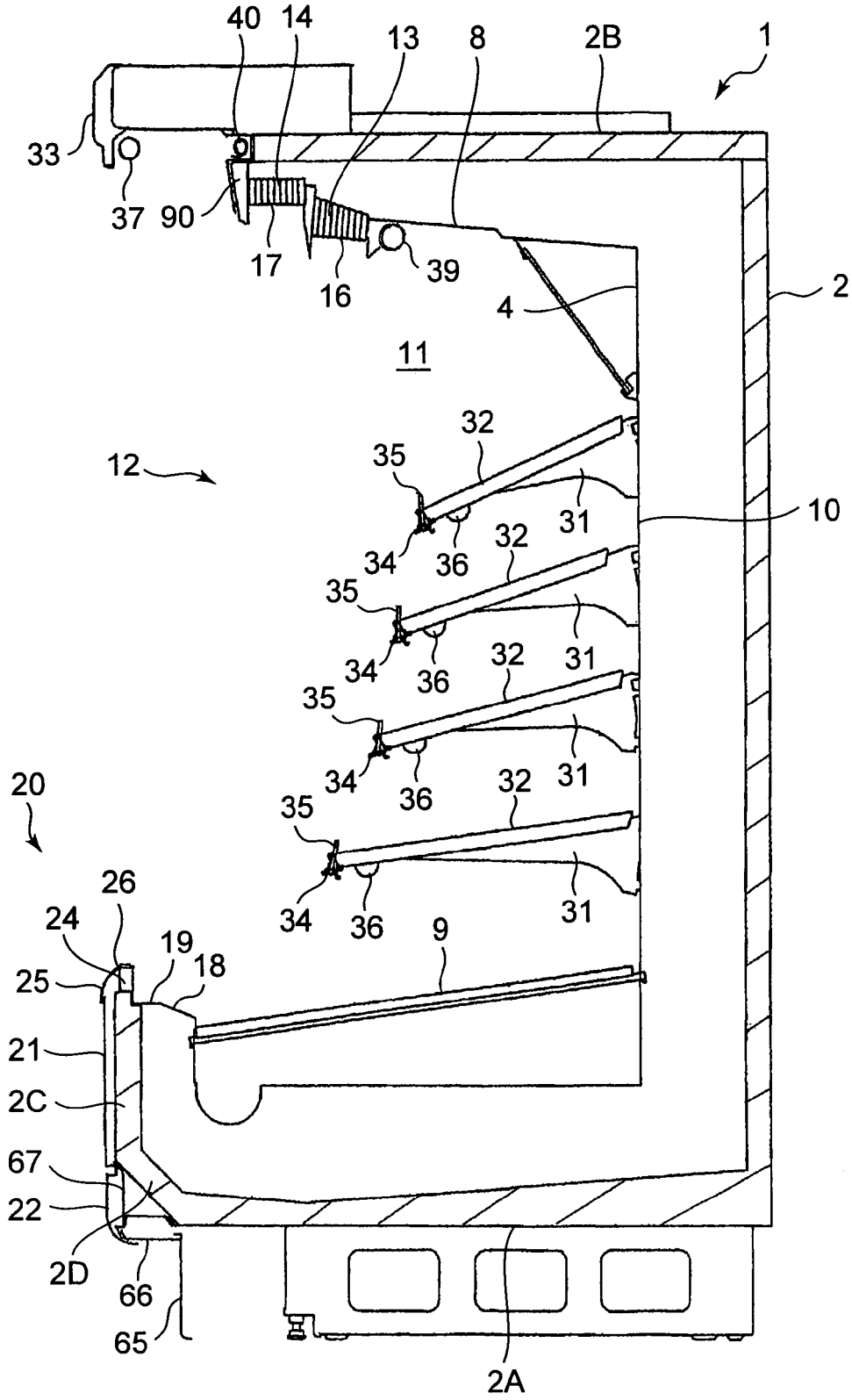
FIG. 2 is a longitudinal cross sectional side view of the open showcase in FIG. 1.

A panel 33 is mounted at the front end of the top wall 2B of the heat insulating wall 2. The panel 33 is provided with a thermometer 38 at the front. In addition, a lamp 37 to illuminate the whole display room 11 is provided at the inner corner of the panel 33 and a lamp 39 also for illuminating the display room 11 from the top is provided at the top partition plate 8 on the display room 11 side of the inner outlet 16. In FIG. 2, reference numeral 40 represents a night cover to prevent the cool air in the display room 11 from leaking to outside during the time other than the business hours (at night, for example). In this embodiment, it comprises a roller screen and is provided in the space formed between the upper front wall of the heat insulating wall 2 and the top of the outlet outer wall 90, which is located at the front of the outer outlet 17 and directed toward the front bottom.

On the other hand, a lower front wall 2C of the heat insulating wall 2 has a retreating section 2D at the bottom thereof, which retreats to the front end of the bottom wall 2A. The retreating section 2D is formed continuously with the front end of the bottom wall 2A. The front wall 2C has a handrail 20 mounted on its top and a front lower panel 21 mounted on its front. A bumper 22 is mounted to the front of the retreating section 2D so that it is substantially flush with the front lower panel 21.

Figure 3:
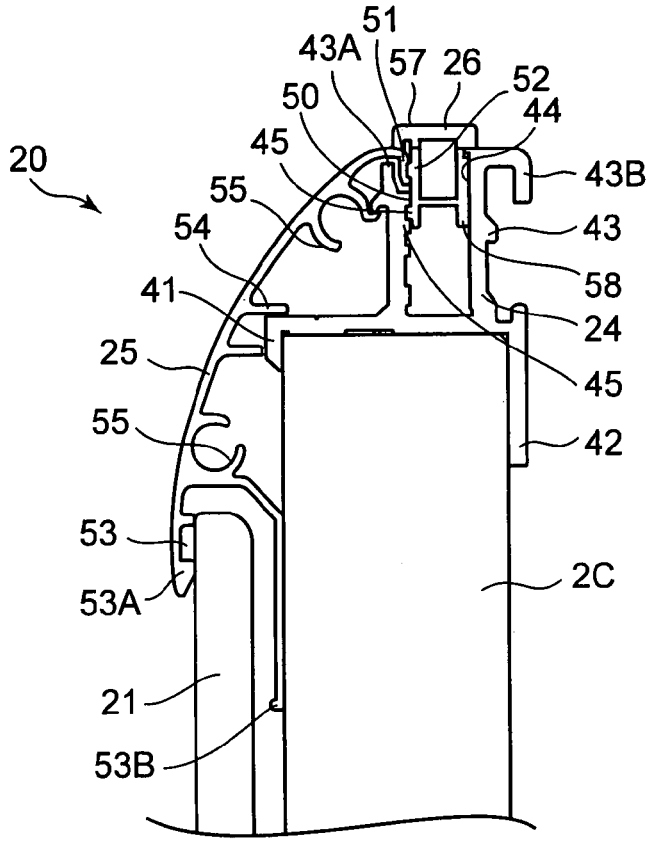
FIG. 3 is a longitudinal cross sectional side view of the open showcase around the handrail.
Figure 4:
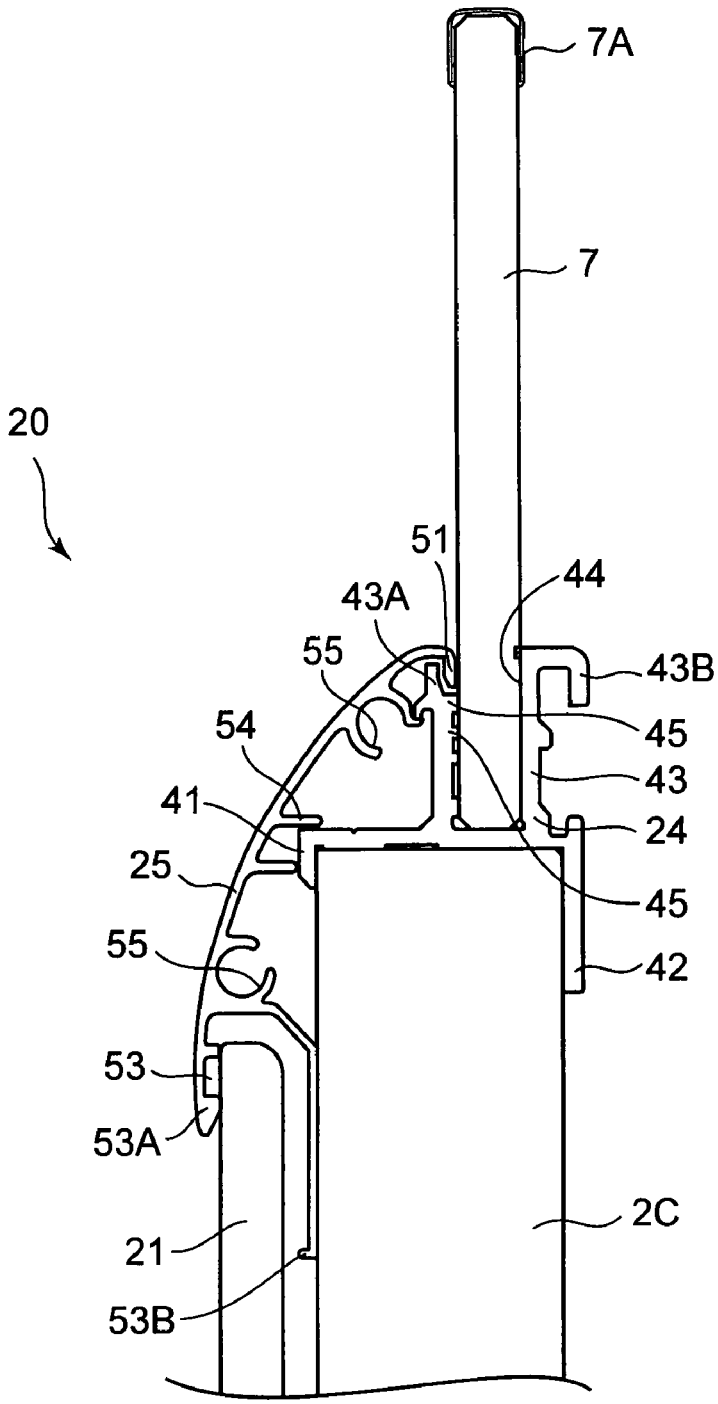
FIG. 4 is a longitudinal cross sectional side view of the open showcase around the handrail with a front glass mounted.

Referring to FIGS. 3 and 4, the configuration of the handrail 20 is explained below. FIG. 3 shows a longitudinal cross sectional side view of the open showcase around the handrail 20, and FIG. 4 shows a longitudinal cross sectional side view of the open showcase around the handrail 20 with a front glass 7 mounted.

The handrail 20 comprises a handrail body 24, a front upper panel 25 and a top cover 26. The handrail body 24 is provided to extend over the whole width of the bottom of the opening 12 of the showcase 1 and is made of hard synthetic resin. The handrail body 24 is provided from the front to the back of the top of the lower front wall 2C of the heat insulating wall 2, and has downwardly extending holding pieces 41 and 42 formed at the front end and the rear end of the handrail body 24. The handrail body 24 is fixed to the lower front wall 2C of the heat insulating wall 2 with these pieces.

The handrail body 24 located at the top of the lower front wall 2C of the heat insulating wall 2 has a front glass holder 43 formed upright at the top thereof. The front glass holder 43 has a recessed groove 44 with upper opening. The end of the front glass 7 (details will be described later) can be inserted in the recessed groove 44. A plurality of holding protrusions 45 for holding the inserted front glass 7 are formed in an inner surface of the recessed groove 44, the inner surface located at the front side in this embodiment. The holding protrusions 45 constitute an engagement section to be engaged with protrusions 50 formed on the top cover 26 described later.

A front wall top 43A constituting the front section of the front glass holder 43 is slightly displaced forward and defines a predetermined space with the top cover 26 or other parts at least in the condition where the top cover 26 or the front glass 7 is mounted.

In addition, a duct plate mounting section 43B extends backward at the back of this front glass holder 43. An outlet duct plate (not shown) where the inner layer suction port 18 and the outer layer suction port 19 described above are formed is inserted into and held by the duct plate mounting section 43.

The front upper panel 25 is provided over the whole width of the bottom of the opening 12 of the showcase 1 as in the case of the handrail body 24 described above. It consists of steel plate materials finished with painting. Further, the front upper panel 25 is bent at a predetermined curvature from the upper end to the lower end. An engagement section 51 folded downward substantially at a right angle is formed at the upper end of the front upper panel 25. The lower end of the front upper panel 25 has a substantially inverted U-shape in cross section with a lower opening. It serves as a lower panel holder 53 to removably retain the front lower panel 21 from below. Holders 53A and 53B are formed at the lower end of the holding part of the lower panel holder 53 located on the outer side and at the lower end of the holding part on side of the heat insulating wall 2, and protrude toward the front lower panel 21 to be housed therein. Therefore, the front lower panel 21 housed in the lower panel holder 53 does not fall off easily.

In addition, approximately at the middle of the front upper panel 25, a holding piece 54 is formed at the position corresponding to the front holding piece 41 of the handrail body 24 as a protrusion extending toward the handrail body 24. Connecting pin housing sections 55 are formed above and below the holding piece 54. These connecting pin housing sections 55 hold connecting pins 56, 56 inserted in them when the pins are used for aligning the height of the handrails 20 of the adjacently installed showcases 1 connected for use. In this embodiment, the higher positioned connecting pin housing section 55 is formed at a position close to the front wall of the handrail body 24 and the lower positioned connecting pin housing section 55 is formed integrally with the top constituting the lower panel holder 53.

The top cover 26 is a member to cover the recessed groove 44 in case the front glass 7 is not mounted on the recessed groove 44 of the handrail body 24. As in the case of the handrail body 24, it is provided to extend over the whole width of the lower edge of the opening 12 of the showcase 1. The top cover 26 is made of soft synthetic resin and, as shown in FIG. 3, is formed integrally with the cover section 57 which covers the space from the upper edge of the front upper panel 25 to the upper edge of the rear wall constituting the rear section of the front glass holder 43, as well as with the insertion section 58 which extends downward from the bottom of the cover section 57.

In this embodiment, the insertion section 58 has protrusions 50 and 52 protruding forward at the front. The protrusions 50 are, when inserted in the spaces between several holding protrusions 45 formed in the recessed groove 44 of the handrail body 24, removably engaged. In addition, the protrusion 52 is formed at the position in contact with the engagement section 51 of the front upper panel 25 that is inserted to and retained at the space between the top cover 26 and the front wall top 43A of the handrail body 24. Thus, the insertion section 58 of the top cover 26 can be held substantially securely in the recessed groove 44 of the handrail body 24.

With the above-described configuration, when the handrail 20 is mounted on the lower front wall 2C of the heat insulating wall 2, the handrail body 24 is firstly mounted on the lower front wall 2C so that the front and rear holding pieces 41 and 42 sandwich the top of the lower front wall 2C. After that, the engagement section 51 of the front upper panel 25 is engaged with the front wall top 43A of the handrail body 24. The holding piece 54 formed on the front upper panel 25 is held at the top of the holding piece 41 of the handrail body 24 here. Thus, the handrail body 24 and the front upper panel 25 are stably mounted on the lower front wall 2C of the heat insulating wall 2.

On the other hand, the front glass 7 is a transparent rectangular flat glass plate having a dimension over substantially the whole width of the front opening 12. A glass frame 7A is mounted at the top and a packing (not shown) is mounted at the bottom.

In case the showcase is used with the front glass 7 mounted on the handrail 20, the bottom of the front glass 7 is inserted into the recessed groove 44 of the front glass holder 43 formed in the handrail 24, as shown in FIG. 4, so that it is set upright at the handrail 20. At that time, the back of the front glass 7 housed in the recessed groove 44 is supported by the inner side of the back of the recessed groove 44 constituting the rear section of the front glass holder 43; at the same time, it is also supported by the holding protrusions 45 formed inside of the front side of the recessed groove 44 constituting the front section of the front glass holder 43 and by the back of the engagement section 51 of the front upper panel 25. The front glass 7 are sandwiched by these parts and held stably. Thus, the front glass 7 can be erected at the handrail 20 positioned at the lower edge of the opening 12 of the open showcase 1.

On the other hand, in case the showcase is used without the front glass 7 mounted, the top cover 26 is mounted on the handrail body 24, as shown in FIG. 3. That is, the insertion section 58 of the top cover 26 is inserted in the recessed groove 44 formed in the front glass holder 43 of the handrail body 24. At that time, the back of the insertion section 58 housed in the recessed groove 44 is supported by the inner side at the back of the recessed groove 44. The protrusions 50 formed at the front of the insertion section 58 are engaged with the holding protrusions 45 as the engaged section formed inside of the front section of the recessed groove 44. The protrusion 52 is supported by the back of the engagement section 51 of the front upper panel 25.

Thus, the top cover 26 is sandwiched by these parts and, with the protrusions 50 of the insertion section 58 engaged with the holding protrusions 45 as the engaged section of the recessed groove 44, stably closes the recessed groove 44. Especially, the protrusions 50 of the insertion section 58 can, when engaged with the engaged section formed on the recessed groove 44, secure the mounting of the insertion section 58. This solves the problem that the top cover 26 is lifted from the handrail body 24 and falls off while goods are placed in and removed from the display room 11.

With the top cover 26 mounted on the recessed groove 44, the cover section 57 formed integrally with the insertion section 58 is provided along the section from the top edge of the front upper panel 25 to the top edge of the rear wall forming the rear section of the font glass holder 43 to cover them.

Thus, even in case the front glass 7 is not mounted, the insertion section 58 goes into the recessed groove 44 and the cover section 57 covers the whole groove, and it becomes possible to conceal the recessed groove 44. The problem of dust deposition in the recessed groove 44 opening upward can be solved.

The cover section 57 of the top cover 26 covers the top of the front upper panel 25. The top of the front upper panel 25 and the painted surface around it are protected by the top cover 26 made of soft synthetic resin. The showcase can be designed so that, when goods are placed in and removed from the display room 11, it is difficult for the worker and the customer to directly touch the top end of the front upper panel 25. Therefore, the front upper panel 25 finished with painting becomes less vulnerable and it becomes possible to prevent peeling off of the paint and suppress fine splits of the painted surface caused by several repeated flaws. This reduces the deterioration of the painted surface by time of the front upper panel 25 and, even after the service life, the appearance deterioration can be suppressed and a good appearance can be maintained.

Figure 5:
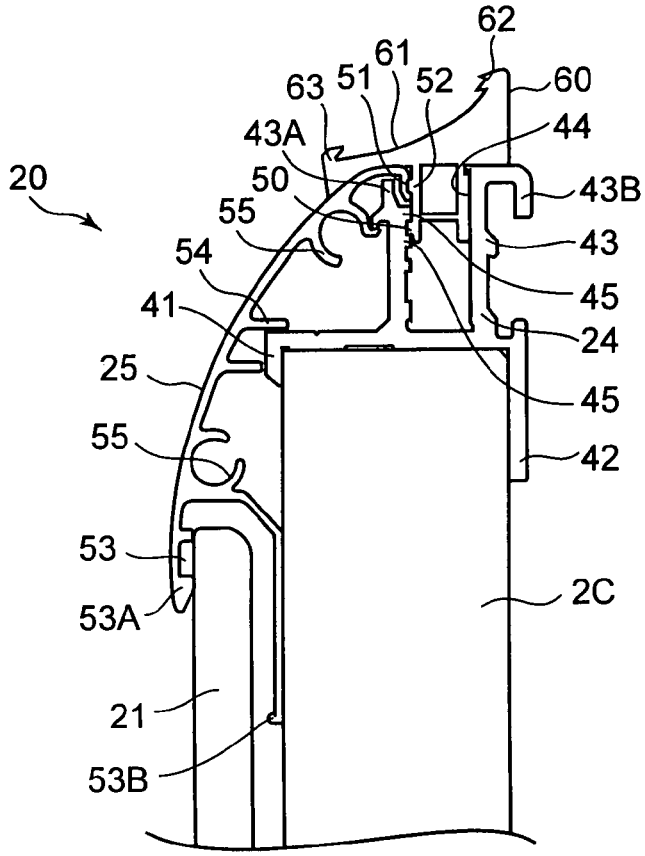
FIG. 5 is a longitudinal cross sectional side view of the open showcase around the handrail with a top cover mounted as another embodiment.

It is to be understood that the top cover 26 constituting the handrail 20 above is not limited to the configuration as explained above. It may have a configuration as a top cover 60 shown in FIG. 5, for example. In the top cover 60 in FIG. 5, a card holder 61 is formed integrally with the insertion section 58 instead of the cover section 57 constituting the top cover 26.

The card holder 61 is provided along the section from the top of the front upper panel 25 to the top of the rear wall forming the rear section of the front glass holder 43. The card holder 61 has the front end lower than the rear end. It has a latch piece 62 formed forward at the rear end and has a latch piece 63 formed toward the above latch piece 62 at the front end. The section between these latch pieces 62 and 63 is formed with a recessed warp and these latch pieces 62 and 63 removably hold the indication cards (not shown) made by paper or resin sheet showing the names and prices of the goods displayed in the display room 11.

To mount the top cover 60 with the above configuration, the insertion section 58 is inserted into the recessed groove 44 of the handrail body 24 as in the case of the top cover 26. Thus, similarly to the case of the top cover 26, the recessed groove 44 is stably closed by engagement between the protrusions 50 of the insertion section 58 and the holding protrusions 45 as the engaged section on the recessed groove 44 side.

In addition, with the top cover 60 mounted to the recessed groove 44, the card holder 61 formed integrally with the insertion section 58 is provided along the section from the top of the front upper panel 25 to the top of the rear wall forming the rear section of the front glass holder 43 to cover them. Thus, even in case the front glass 7 is not mounted, as in the above case of the top cover 60, the insertion section 58 goes into the recessed groove 44 and the card holder 61 covers the whole groove and it becomes possible to conceal the recessed groove 44. Therefore, the problem of dust deposition in the recessed groove 44 opening upward can be solved.

Further, the card holder 61 of the top cover 60 covers the top of the front upper panel 25 over a larger range than the cover section 57 of the top cover 26 and the top edge of the front upper panel 25 and the painted surface around it for a wider range is protected by the top cover 60 made of soft synthetic resin. When the goods are placed in and removed from the display room 11, it is difficult for the worker and the customer to directly touch the top end of the front upper panel 25. Therefore, the front upper panel 25 finished with painting becomes less vulnerable and it becomes possible to prevent peeling off of the paint and suppress fine splits of the painted surface caused by several repeated flaws. This reduces the deterioration of the painted surface by time of the front upper panel 25 and, even after the service life, the appearance deterioration can be suppressed and a good appearance can be maintained.

Furthermore, the top cover 60 can removably hold the indication card at the card holder 61. It is possible to arbitrarily attach the information about the displayed goods with maintaining a uniform feeling of the showcase as a whole, which improves the convenience.

Figure 6:
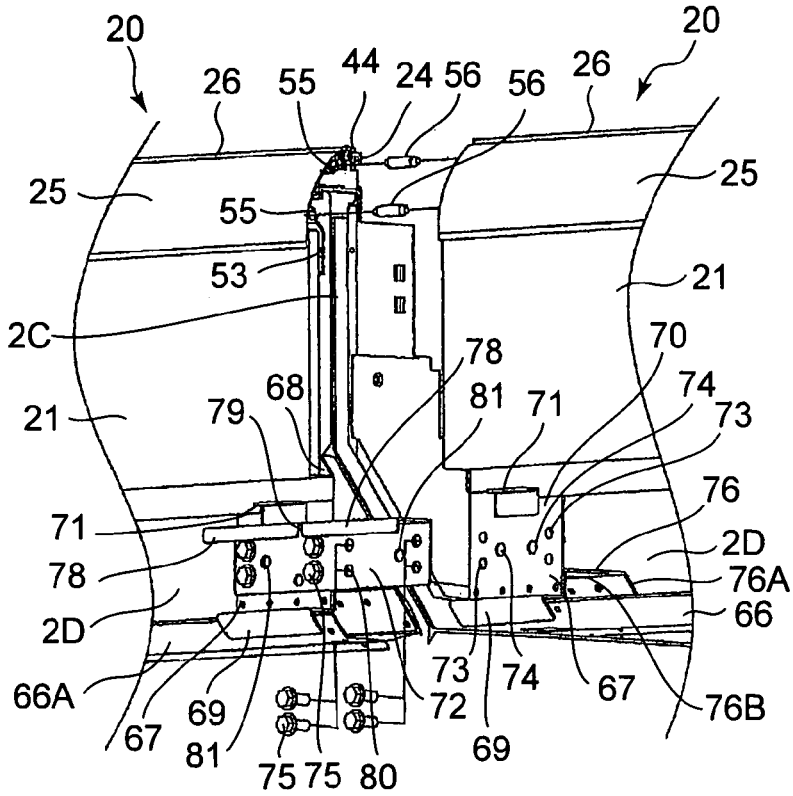
FIG. 6 is an exploded perspective view of the connection section.
Figure 7:
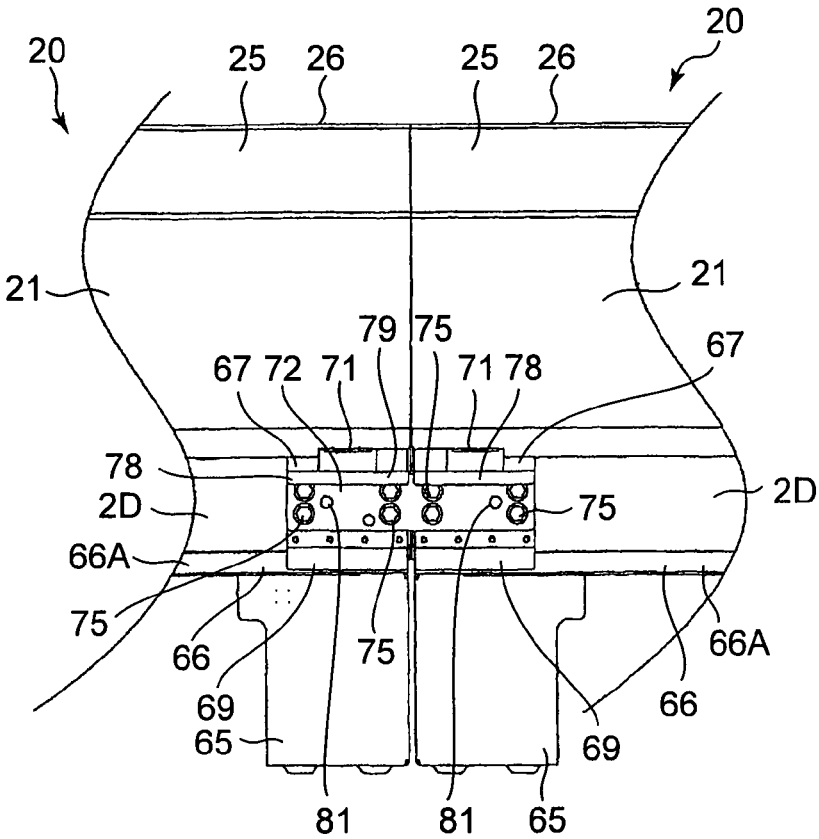
FIG. 7 is a front view of the connection section in the connected state.
Figure 8:
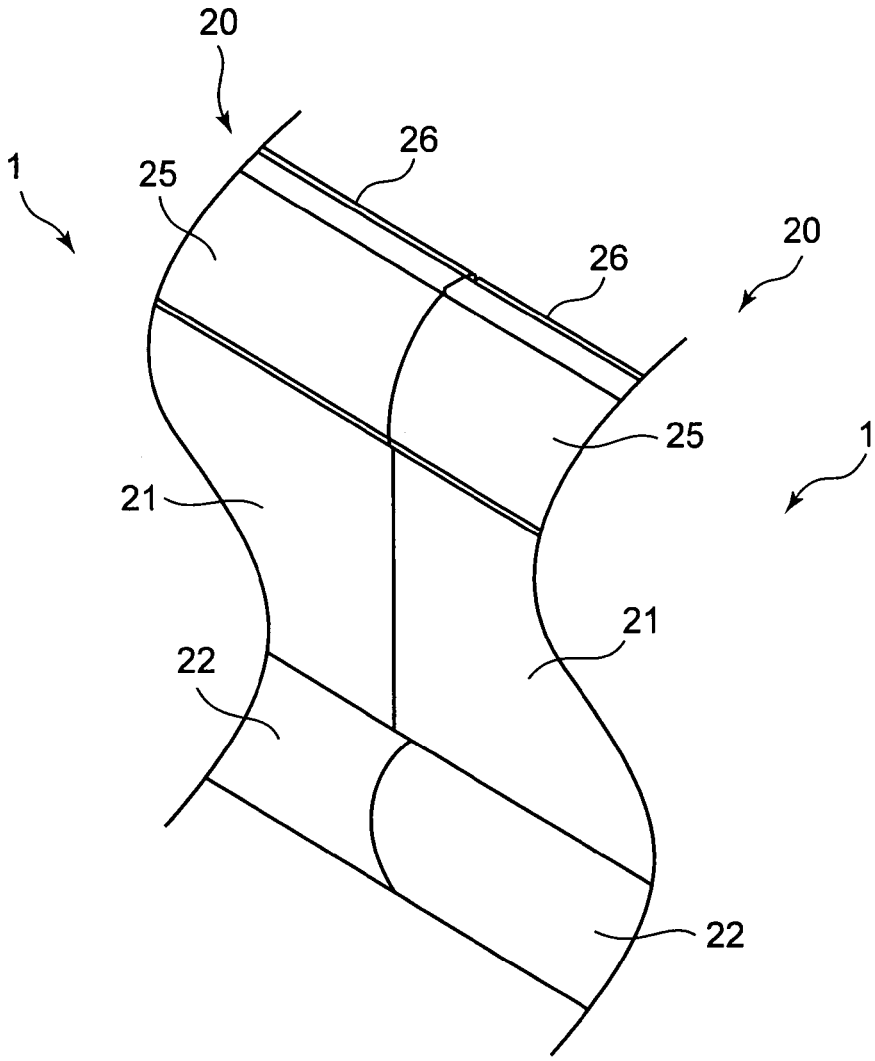
FIG. 8 is a partial perspective view of the connected open showcases.

Next, referring to FIGS. 6 to 8, the connection structure to connect two open showcases 1 is explained below. FIG. 6 is an exploded perspective view of the connection section, FIG. 7 is a front view of the connection section in the connected state, and FIG. 8 is a partial perspective view of the connected open showcases 1.

A forwardly extending lower holding plate 66 extending forward is attached to the upper part of the front panel 65 positioned at the bottom of the bottom wall 2A of the heat insulating wall 2 or below it and, in this embodiment, provided below the front end of the bottom wall 2A. The front end of the lower holding plate 66 is bent upward with a predetermined angle and serves as a holding surface 66A, and the top end of the holding surface 66A extends to the position a little backward from the position substantially flush with the lower front wall 2C of the heat insulating wall 2.

A receiving metal 67 constituting a connection device together with the connecting metal 72 (described later) is fixed to the retreating section 2D of the heat insulating wall 2 at the position of the side end of each open showcase 1. The receiving metal 67 is made of steel plates, and comprises a top mounting piece 68 whose top end is folded along the inclination angle of the retreating section 2D, a mounting surface 70 substantially parallel with the lower front wall 2C when mounted on the retreating section 2D, and a bottom mounting piece 69 whose front end is, after the bottom of the mounting surface 70 is once bent forward substantially at a right angle, bent at an angle to cover the front of the holding face 66A of the lower holding plate 66. The top mounting piece 68 has a plurality of fixing holes in which bolts for fixing to the retreating section 2D are inserted. At the same time, the lower section of the mounting surface 70 located immediately above the lower mounting piece 69 has a plurality of fixing holes in which the bolts for fixing to a mounting face 76B of a mounting member 76 (described later) are inserted.

The mounting surface 70 has, at its top, a support piece 71 partially cut and folded upward substantially at a right angle around the top end and, slightly above the support piece 71, fixing holes (not shown) to fix the front lower panel 21 and the bumper 22 together at the both ends. In addition, the mounting surface 70 is provided with two mounting holes 73 on the right and left respectively (four holes in total) for fixing the connecting metal fitting 72 to both sides with bolts 75 at the lower section of the support piece 71. Located on the inner side of the mounting hole 73 are drawing holes 74 for insertion of a drawing tool.

On the other hand, the mounting member 76 is mounted at the bottom of the retreating section 2D of the heat insulating wall 2. Its rear end is folded downward along the inclination angle of the retreating section 2D and serves as a fixing surface 76A. Its front end is folded downward substantially at a right angle along the back of the mounting surface 70 for the receiving metal 67 and serves as the mounting surface 76B.

With the above configuration, the fixing surface 76A of the mounting member 76 is firstly fixed to the bottom of the retreating section 2D of the heat insulating wall 2 using bolts. This positions the mounting member 76 at the top of the lower holding plate 66. Then, the horizontal surface constituting the bottom mounting piece 69 of the receiving metal 67 is placed at the top of the lower holding plate 66. Under this state, the bottom mounting piece 69 of the receiving metal 67 is positioned at the front of the lower holding piece 66A of the lower holding plate 66 and the lower section of the mounting surface 70 of the receiving metal 67 is in contact with the mounting surface 76B of the mounting member 76 fixed to the retreating section 2D. It is fixed with the bolts to the mounting surface 76B using the fixing holes formed in the mounting face 70 of the receiving metal 67. Thus, the mounting surface 70 of the receiving metal 67 faces forward at the front of the retreating section 2D of the heat insulating wall 2, at the position a little withdrawn from the front of the lower front wall 2C.

The front lower panel 21 mounted to the front of the lower front wall 2C of the heat insulating wall 2 under this state is, with its top inserted into the lower panel holder 53 of the front upper panel 25 constituting the handrail 20, supported by the support piece 71 of the receiving metal 67 at the bottom. Therefore, the longitudinally configured front lower panel 21 can be mounted tentatively to the lower front wall 2C without using any tool, which improves the workability. This also causes the front lower panel 21 to be continued from the lower side of the front upper panel 25.

The connecting metal 72 is made of steel plate materials. Formed at its top is a bumper contact edge 78, which is folded forward substantially at a right angle and then the front end is folded downward substantially at a right angle. At the center of the bumper contact edge 78, a bumper engagement groove 79 is formed to house and to be engaged with the edge of the bumper 22 mounted on the both showcases 1.

At the front of the connecting metal 72, a plurality of mounting holes 80 are formed for fixing with the receiving metal 67, which is mounted to both of the adjacent showcases 1. In this embodiment, these mounting holes 80 are formed at the positions enabling overlap with four mounting holes 73 formed in the receiving metal 67 of the showcases 1 (there are eight holes in total). They can be fixed with the bolts 75.

Further, on the inner side of the mounting hole 80 of the connecting metal 72, a drawing hole 81 to enable insertion of the drawing tool is formed and is overlapped with the drawing hole 74 formed in the receiving metal 67 described above.

The procedure to connect the adjacent open showcases 1 with the above configuration is described below. Firstly, the sides of the heat insulating walls 2 of the open showcases 1 and 1 are brought into abutment with each other so that their lower front walls 2C of the heat insulating walls 2 become substantially flush with each other. Then, the connecting pins 56 and 56 are inserted into the connecting pin housing sections 55 and 55 at the front upper panel 25 constituting the handrail 20 of one showcase 1.

The connecting metal 72 is mounted over the receiving metals 67 and 67 mounted on the front of the retreating sections 2D of the both showcases 1. In this case, the mounting holes 73 of one receiving metal 67 are firstly overlapped with the mounting metals 80 of the connecting metal 72, and they are screwed and fixed with the bolts 75. Then, the mounting holes 73 of the other receiving metal 67 and the mounting hole 80 of the connecting metal 72 are overlapped and are screwed and fixed with the bolts 75.

It is difficult to position the showcase 1 itself finely because of its heavy weight. Even if the sides of the heat insulating walls 2 are put together as described above so that their lower front walls 2C become substantially flush, there are still some difference in their positions. Here, the drawing tool is firstly inserted into the drawing hole 81 of the connecting metal 72 and, keeping this state, inserted into the drawing hole 74 of the receiving metal 67 and is operated to align them exactly. Thus, the lower front wall 2C of the showcase 1 positioned a little different from the lower front wall 2C of the other showcase 1 can be drawn so that their front surfaces become substantially flush.

Since this drawing process enables clearing of small difference, it becomes possible to connect the front faces of the heat insulating walls 2 of both showcases 1 without any gap.

Further, because the drawing hole 74 to be engaged with the drawing tool is formed on the mounting surface 70 of the receiving metal 67, it becomes possible to conduct the work at the front side of the heat insulating wall 2, which facilitates the drawing process.

With the other showcase 1 drawn by the connecting metal 72 without any gap and so that the lower front walls 2C are substantially flush as described above, the mounting holes 73 of the receiving metal 67 are overlapped with the mounting holes 80 of the connecting metal 72 so that they are screwed and fixed with the bolts 75.

Thus, it becomes possible to connect the adjacent showcases 1 at the front side facing the lower front wall 2C instead of the retreating section 2D at the back of the lower front wall 2C of the heat insulating wall 2, which improves the workability. It also becomes possible to securely fix the connecting metal 72 and the receiving metals 67. Even in case one showcase 1 is hit by a cart or the like used in the shop, any displacement at the connecting section can be avoided.

Under this situation, the connecting pin 56 mounted to the front lower panel 21 constituting the handrail 20 of one showcase 1 is housed in the connecting pin housing section 55 of the front lower panel 21 constituting the handrail 20 of the other showcase 1 in the phase of connection with the connecting metal 72 as described above. Thus, the handrails 20 of the both showcases 1 can be easily adjusted for their heights and it becomes possible to connect the handrails 20 without any difference in height.

The bumpers 22, 22 as described above are mounted to the front of the retreating section 2D of the heat insulating wall 2 respectively for both of the showcases 1 connected by the connecting metal 72. Here, the top of the bumper 22 is retained with the support piece 71 of the receiving metal 67 supporting the lower end of the front lower panel 21, and its bottom end is retained with the bottom of the lower section holding plate 66. In addition, the ends corresponding to the connection sections of the both bumpers 22 are engaged inside of the bumper engagement groove 79 formed in the connecting metal 72. With this status, the rear face of the bumper 22 is in contact with the bumper contact edge 78 of the connecting metal 72 and the strength of the bumper 22 is maintained.

Thus, the retreating section 2D of the heat insulating wall 2 including the connection device consisting of the receiving metal 67 mounted to the showcases 1 and the connecting metal 72 is concealed by the bumpers 22. Note that the lower holding plate 66 positioned at the front of the retreating section 2D houses, at its top, electric accessories such as a controller of a part of the showcase 1 or the like. By mounting of the bumper 22, these accessories are also concealed.

Thus, by fixing both receiving metals 67 mounted to the retracted section 2D of the both showcases 1 using the connecting metal 72, it becomes easy to flush the front surfaces of the heat insulating walls 2 of the both showcases 1, and the front faces of the insulations wall 2 of the both showcases 1 can be exactly flushed. Therefore, by connecting both showcases 1 without a gap, the unity and the continuity are improved, which results in a better appearance.

This eliminates the need of a cover member to cover the joining section and it becomes possible to provide a further sense of unity and continuity by connection of showcases 1. In addition, because any concave or convex sections are not formed at the connecting sections of the bumpers 22 and handrails 20, deposition of dust or the like can be suppressed, which improves cleaning facility and enables use in a good hygiene status.

What is claimed is:

1. An open showcase comprising a heat insulating wall with an opening and a handrail arranged at a top of a front wall of the heat insulating wall positioned at a bottom of the opening;

wherein said handrail comprises a handrail body mounted on the top of said front wall and having a recessed groove further comprising an upper opening for insertion of a front glass therein, a front upper panel extending from inside the recessed groove to an upper part of a front surface of said front wall, and a top cover inserted removably in said recessed groove to close the recessed groove and cover the top of said front upper panel and a portion of said handrail body, wherein the handrail body comprises a first engagement section in which a first protrusion of said top cover is engaged, and the first engagement section is formed within the recessed groove of said handrail body, the front upper panel comprises a second engagement section in which a second protrusion of said top cover is engaged, wherein the second engagement section is disposed within the recessed groove of said handrail body and wherein the second engagement section is above the first engagement section.

2. The open showcase according to claim 1, wherein a card holder for removably holding a card is integrally and unitarily formed with said top cover at the top thereof.

3. The open showcase according to claim 1, wherein the handrail body and the front upper panel are not unitary with one another.

4. The open showcase according to claim 3, wherein the handrail body comprises resin and the front upper panel comprises steel.

* * * * *